United States Patent [19]

Heiman

[11] 4,188,961

[45] Feb. 19, 1980

[54] COIN MECHANISM EXACT CHANGE INDICATOR APPARATUS

[75] Inventor: Frederic P. Heiman, Philadelphia, Pa.

[73] Assignee: Mars, Inc., McLean, Va.

[21] Appl. No.: 843,286

[22] Filed: Oct. 18, 1977

[51] Int. Cl.[2] ..... G07D 1/06; G07F 5/24

[52] U.S. Cl. ..... 133/2; 194/1 N

[58] Field of Search ..... 133/2, 4 R, 4 A; 194/1 L-1 N

[56] References Cited

U.S. PATENT DOCUMENTS

| | | | |
|---|---|---|---|
| 2,802,474 | 8/1957 | Du Grenier. | |
| 3,131,702 | 5/1964 | Buchholz. | |
| 3,190,426 | 6/1965 | Cahill et al. | |
| 3,200,828 | 8/1965 | Offutt. | |
| 3,244,185 | 4/1966 | Vaccaro. | |
| 3,250,363 | 5/1966 | Hooker. | |
| 3,335,838 | 8/1967 | Schuller et al. | |
| 3,368,570 | 2/1968 | Nagy et al. | |
| 3,406,803 | 10/1968 | Offutt et al. | |
| 3,490,571 | 1/1970 | Bauer. | |
| 3,527,330 | 9/1970 | Schmitt et al. . | |
| 3,550,742 | 12/1970 | Pennell et al. . | |
| 3,815,717 | 6/1974 | Arseneau | 194/1 N |
| 3,820,642 | 6/1974 | Levasseur. | |
| 3,828,903 | 8/1974 | Levasseur. | |
| 3,896,915 | 7/1975 | Hayashi et al. | 194/1 N |
| 3,963,035 | 6/1976 | Levasseur | 194/1 N X |
| 4,034,839 | 7/1977 | Lee | 194/1 N X |
| 4,056,181 | 11/1977 | Ikeguchi et al. . | |

*Primary Examiner*—Joseph J. Rolla
*Assistant Examiner*—Edward M. Wacyra
*Attorney, Agent, or Firm*—Davis, Hoxie, Faithfull & Hapgood

[57] ABSTRACT

An apparatus for communicating the inability of a coin change making mechanism to return correct change in which the availability of coin denominations to make change is compared with the value of required change for a given transaction.

8 Claims, 4 Drawing Figures

COIN MECHANISM EXACT CHANGE INDICATOR APPARATUS

The present invention relates to coin change making mechanisms as used, for example, in vending machines, and more particularly to an improved apparatus for communicating the mechanism's inability to return correct change.

Most coin change making mechanisms now in use display an indication that exact change is required when the level of coins in any one of its coin delivering storage receptacles reaches a predetermined minimum level. The mechanism thereafter refuses to accept coins of the largest acceptable denomination until the level of coins is above the minimum, even if the customer desires to purchase a product whose price is equivalent to the value of the largest acceptable denomination coin. In many such mechanisms, however, the user may make a selected purchase by overpaying for it. Thus two 10-cent coins may be deposited for a 15-cent product and the product will be dispensed, but no change will be returned if the 5-cent coin storage receptacle is empty.

The commonly used exact change indication method is particularly unsatisfactory in coin change making mechanisms capable of returning change in two or more denominations, for example, 5-cent and 10-cent coins. Thus, when such a mechanism can no longer return 5-cent coins, it may still have a sufficient supply of 10-cent coins to make change for transactions requiring change in multiples of 10-cents. The commonly used coin change making mechanisms, however, indicate that exact change is required whenever coins in the 5-cent coin delivering receptacle have reached their minimum level and 25-cent coins are rejected.

The apparatus of the present invention alleviates exact change problems in coin change making mechanisms by prohibiting vending of the product when correct change cannot be returned for the combination of product price and coins deposited by the customer, and alerts the customer to this condition. Unlike the common type of coin change making mechanism, the apparatus of the present invention indicates the inability to return change based upon a comparison of the value of deposited coins, the price of the selected product and the denominations of coins available to make the necessary change—determined after the deposited coins are accepted.

According to my invention, the value of coins deposited in the coin change making mechanism is initially determined. The required change, if any, is then determined by comparing this value with the price for a selected purchase. The availability of coin denominations in the coin storage receptacles of the mechanism is examined through the use of sensors which monitor the level of coins in the receptacles. In the event that the mechanism cannot make change, the value of the deposited coins can be automatically refunded by conventional escrow means.

The ability of the coin change making mechanism to return correct change is determined by comparing the value of required change with the availability of coin denominations for returning change. An electrical signal is generated as a result of the foregoing analysis. The signal is indicative of the ability of the coin change making mechanism to return correct change.

If the mechanism is able to return correct change or no change is required, the generated signal is used to actuate the vending of the selected product and the return of any change. If the mechanism is unable to return correct change, the generated signal can be used to indicate this fact to the customer to permit him to either select a product at another price or manually actuate the coin return. Alternatively, if the mechanism is unable to return correct change, the generated signal can be used to indicate this fact to the customer and automatically return the value of the inserted money.

The drawings are representational and are not necessarily drawn to scale.

Figure 1:
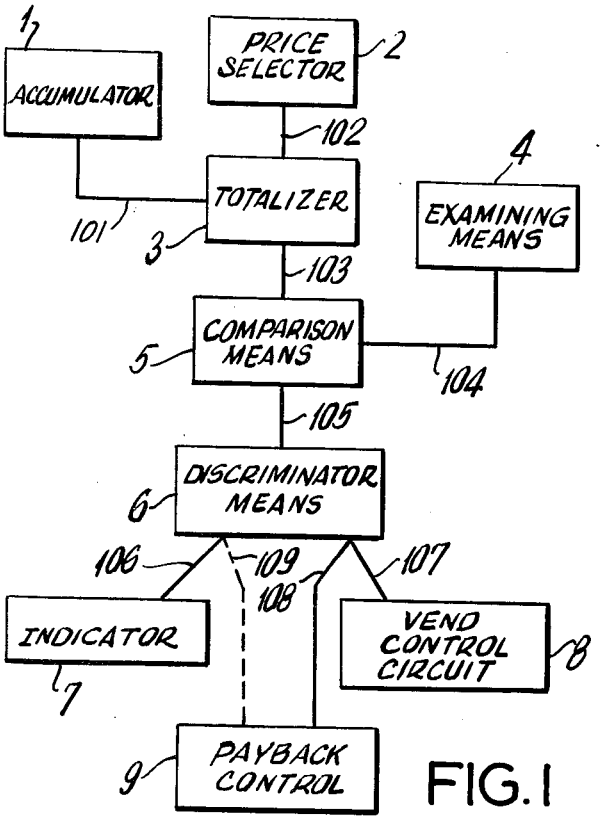
FIG. 1 is a schematic block diagram of the embodiment of my invention.
Figure 3:
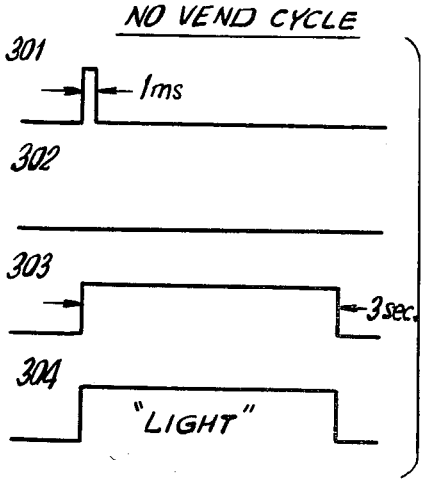
FIG. 3 is a waveform diagram relating to the description of FIG. 2.

The circuit shown schematically in FIG. 1 comprises the accumulator 1 for determining the value of coins deposited in the mechanism. Several known techniques for examining coins to determine their value are capable of being utilized in the present invention, such as the techniques disclosed in U.S. Pat. No. 3,918,565.

The circuit of FIG. 1 also has a totalizer 3, such as an UP/DOWN counter, connected to receive the output signal on wire 101 from the accumulator 1 and a signal on wire 102 from the price selector 2. The signal on wire 102 is indicative of the value of coins required to be deposited. The totalizer 3 is connected to "add" the value of the coins deposited and "subtract" the price, which is the value of the coins required. The output signal on wire 103 indicates the value of coins to be returned as change.

The examining means 4 monitors the level of coins in the coin storage receptacles of the mechanism, using sensors (not shown) in the usual fashion. A signal is produced on wire 104, which indicates the availability of coins of a particular denomination for returning change.

A comparison means 5 is connected to receive the output signal on wire 103 from the totalizer 3 and the signals on wire 104 from the examining means 4. The comparison means 5 is a comparator with three output states. The signal produced by comparison means 5 on wire 105 has a characteristic indicative of the input received. If the comparison of the signal on wire 103 from the totalizer 3 and the signal on wire 104 from the examining means 4 indicates an inability to return correct change, the output signal on wire 105 from the comparator is a relatively high frequency signal having waveform 301.

If the result of comparing the signal on wire 103 from the totalizer 3 and the signal on wire 104 from the examining means 4 indicates the mechanism's ability to return correct change, the output signal on wire 105 from the comparator is a low frequency signal having waveform 401.

The comparison means 5 produces no output signal on wire 105 unless the value of coins deposited equals or exceeds the price.

Figure 2:
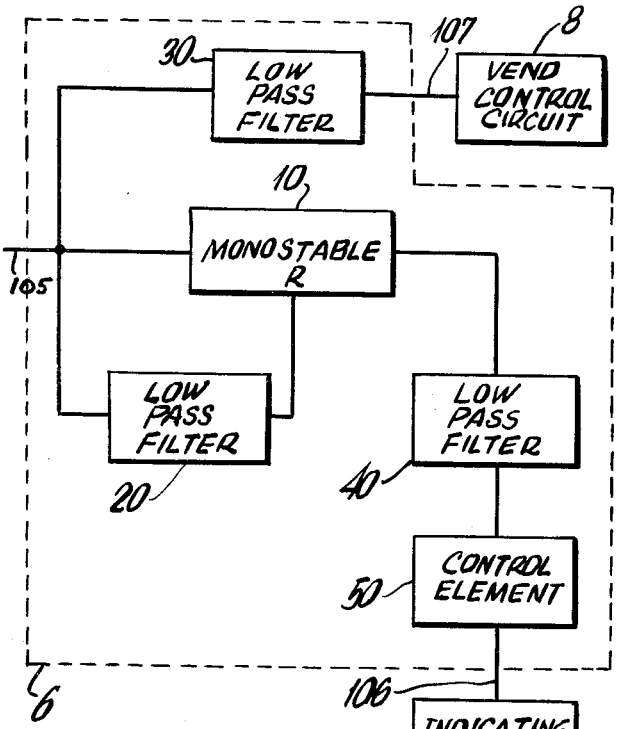
FIG. 2 is a schematic block diagram of the discriminator means used in the embodiment of FIG. 1.
Figure 4:
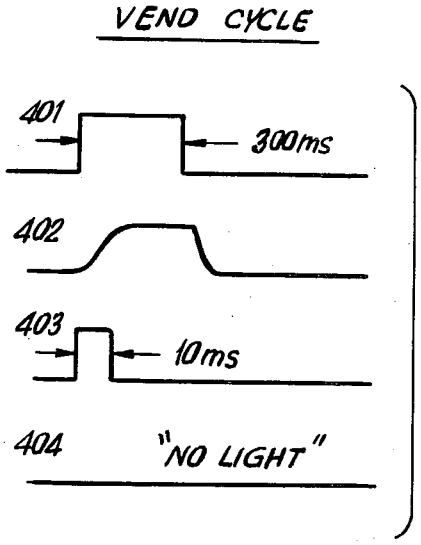
FIG. 4 is another waveform diagram relating to the description of FIG. 2.

The present invention also has a discriminator means 6 for selectively filtering the signal on wire 105 received from the comparison means 5. The discriminator means 6 of FIG. 2 comprises the monostable 10 and the low pass filter 20 both connected to receive the output signal on wire 105 from the comparison means 5. The low pass filter 20 is also connected to the reset terminal of the monostable 10. The low pass filter 30 is connected to receive the output signal on wire 105 from the comparison means 5. The output signal on wire 107 from the low pass filter 30 is applied to the vending machine control circuit 8 for enabling the vending machine to dispense a product when either no change is required or correct change can be returned. The discriminator means 6 also has the low pass filter 40 connected to receive the output signal of the monostable 10. The control element 50, such as a transistor or a relay, is connected to receive the output signal of the low pass filter 40. An indicating device 7, such as a "Use Exact Change" light is connected to receive the output signal of the control element 50.

In operation, the accumulator 1 produces an output signal on wire 101 representative of the value of coins deposited. This output signal and the signal on wire 102, representative of the price for a selected purchase, are received by the totalizer 3. The output signal on wire 103 from the totalizer 3 is received by the comparison means 5. The comparison means 5 also receives a signal on wire 104 from the examining means 4. In my preferred embodiment described herein, the frequency of the output signal on wire 105 from the comparison means 5 is dependent upon the input signals it receives.

When the comparison means produces an output signal on wire 105 having a waveform 301 corresponding to a relatively high frequency indicative of an inability to return correct change, the signal on wire 105 does not pass through the low pass filter 20 causing a signal having waveform 302 to be applied to the reset terminal of the monostable 10. The output signal of the monostable 10 has a waveform 303 which passes through the low pass filter 40 causing a signal having waveform 304 to be applied to the control element 50. The output signal of the control element 50 is applied to the indicating device 7 to alert the user to the fact that correct change cannot be returned. The coin mechanism can be arranged either to permit the user to manually actuate the coin return when he is so alerted or to automatically refund the value of the inserted money by transmitting a refund signal on wire 109 to the payback control 9 which causes refunding by conventional escrow means. The output signal on wire 105 from the comparison means 5 does not pass through the low pass filter 30 and no signal is applied on wire 107 to the vending machine control circuit 8 or on wire 108 to the payback control.

When the comparison means 5 produces an output signal on wire 105 having a waveform 401 corresponding to a relatively low frequency, indicative of the fact that either no change is required or correct change can be returned, this signal passes through the low pass filter 20 causing a signal having waveform 402 to be applied to the reset terminal of the monostable 10. The output signal of the monostable 10, which has a waveform 403, does not pass through the low pass filter 40 causing a signal having waveform 404 to be applied to the control element 50. The indicating device 7 will not be activated in this situation. The output signal on wire 105 from the comparison means 5 also passes through the low pass filter 30 causing a signal on wire 107 to be applied to the vend control circuit 8 to cause a product to be dispensed and a signal is applied on wire 108 to the payback control 9 to cause the correct change to be returned, if any change is required.

I claim:

1. A circuit for communicating the inability of a multi-denomination coin change making mechanism to return correct change comprising an accumulator for determining the value of coins deposited, a totalizer for determining the value of required change from the value of the deposited coins and a vend price, examining means for determining the availability of coin denominations for returning change with respect to two or more denominations, comparison means connected to receive the outputs of said examining means and said totalizer to determine therefrom the inability of said coin change making mechanism to return correct change and produce an output signal having a characteristic indicative of said inability, and a discriminator means responsive to two or more characteristics of said signal, said discriminator means producing one or more signals at its output indicative of the inability or ability to return correct change.

2. The circuit of claim 1 further comprising a visual indicator connected to receive the output of said discriminator means.

3. The circuit of claim 1 further comprising payback control means for automatically refunding the full value of the coins deposited in response to the discriminator means output signal when it is indicative of an inability to return correct change.

4. The circuit of claim 1 further comprising means for applying a discriminator output signal to the control circuit of a vending machine associated with the coin change making mechanism to cause the vending machine to vend a selected product and means for applying said discriminator output signal to the payback control means to permit the change making mechanism to return correct change when the discriminator output signal is indicative of an ability to return correct change.

5. The circuit of claim 1 wherein one characteristic of the comparison means output signal is its frequency, said comparison means comprises a comparator having the ability to generate a signal having two or more substantially different frequencies, and said discriminator means comprises a frequency selective filtering circuit.

6. The circuit of claim 5 further comprising means for applying a discriminator output signal to the control circuit of a vending machine associated with the coin change making mechanism to permit the vending machine to vend a selected product and means for applying said signal to permit the change making mechanism to return correct change when the signal is indicative of an ability to return correct change.

7. The circuit of claim 6 further comprising means for automatically refunding the value of the coins deposited in response to a discriminator output signal indicative of an inability to return correct change.

8. The circuit of claim 5 further comprising a visual indicator connected to receive an output of said discriminator indicative of inability to return correct change.

* * * * *